US012599169B2

(12) United States Patent
Feuerstein et al.

(10) Patent No.: US 12,599,169 B2
(45) Date of Patent: Apr. 14, 2026

(54) AEROSOL GENERATING DEVICE

(71) Applicant: JT International SA, Geneva (CH)

(72) Inventors: Sandro Feuerstein, Embrach (CH); Adrian Schwarz, Islikon (CH); Alec Wright, Guildford (GB); Gabriela Greco Da Fonseca De Carvalho, Chêne-Bourg (CH); Takehiro Mitsutsuka, Geneva (CH)

(73) Assignee: JT International SA (CH)

( * ) Notice: Subject to any disclaimer, the term of this patent is extended or adjusted under 35 U.S.C. 154(b) by 504 days.

(21) Appl. No.: 17/926,881

(22) PCT Filed: May 15, 2021

(86) PCT No.: PCT/EP2021/062903
§ 371 (c)(1),
(2) Date: Nov. 21, 2022

(87) PCT Pub. No.: WO2021/233793
PCT Pub. Date: Nov. 25, 2021

(65) Prior Publication Data

US 2023/0189883 A1 Jun. 22, 2023

(30) Foreign Application Priority Data

May 22, 2020 (EP) ..... 20176127

(51) Int. Cl.
*A24F 40/42* (2020.01)
*A24F 40/00* (2020.01)
(Continued)

(52) U.S. Cl.
CPC ..... *A24F 40/42* (2020.01); *A24F 40/00* (2020.01); *A24F 40/46* (2020.01); *A24F 40/485* (2020.01); *A24F 40/50* (2020.01)

(58) Field of Classification Search
None
See application file for complete search history.

(56) References Cited

U.S. PATENT DOCUMENTS

2013/0327327 A1* 12/2013 Edwards ..... A61M 15/0028 128/203.11
2015/0013696 A1* 1/2015 Plojoux ..... A24F 40/40 131/328

(Continued)

FOREIGN PATENT DOCUMENTS

CN 107319640 A 11/2017
CN 108433195 A 8/2018

(Continued)

OTHER PUBLICATIONS

International Search Report for Application No. PCT/EP2021/062903 mailed Aug. 17, 2021, pp. 1-3.

*Primary Examiner* — Philip Y Louie
*Assistant Examiner* — Madeleine P Delacruz
(74) *Attorney, Agent, or Firm* — Lerner David LLP

(57) ABSTRACT

An aerosol generation device includes: a heating chamber for generating an aerosol by heating a consumable; a consumable port configured to receive the consumable; and a loader configured to move the consumable between a first position at the consumable port and a second position at the heating chamber, wherein the loader is configured to remain within the aerosol generation device at the first position and the second position.

16 Claims, 6 Drawing Sheets

(51) Int. Cl.

| | |
|---|---|
| ***A24F 40/46*** | (2020.01) |
| ***A24F 40/485*** | (2020.01) |
| ***A24F 40/50*** | (2020.01) |

(56) References Cited

U.S. PATENT DOCUMENTS

| | | | | |
|---|---|---|---|---|
| 2016/0353801 | A1 | 12/2016 | Zinovik et al. | |
| 2017/0027226 | A1 | 2/2017 | Mironov et al. | |
| 2018/0049472 | A1 | 2/2018 | Mahler et al. | |
| 2019/0166909 | A1 | 6/2019 | Reevell | |
| 2021/0282458 | A1* | 9/2021 | Aw | A24F 7/02 |
| 2023/0000146 | A1* | 1/2023 | Nicolas | A24F 1/30 |

FOREIGN PATENT DOCUMENTS

| | | | | |
|---|---|---|---|---|
| CN | 109007986 | A | 12/2018 | |
| CN | 210492612 | U | 5/2020 | |
| EP | 2782463 | A2 | 10/2014 | |
| JP | 2014533513 | A | 12/2014 | |
| JP | 2018504134 | A | 2/2018 | |
| JP | 2019050821 | A | 4/2019 | |
| JP | 2019519201 | A | 7/2019 | |
| KR | 101084048 | B1 | 11/2011 | |
| KR | 20140093694 | A | 7/2014 | |
| KR | 20160119765 | A | 10/2016 | |
| KR | 20180134914 | A | 12/2018 | |
| WO | 2019014990 | A1 | 1/2019 | |
| WO | 2019030167 | A1 | 2/2019 | |
| WO | WO-2020141064 | A1 * | 7/2020 | A24F 15/00 |

* cited by examiner

AEROSOL GENERATING DEVICE

CROSS-REFERENCE TO RELATED APPLICATIONS

The present application is a national phase entry under 35 U.S.C. § 371 of International Application No. PCT/EP2021/062903, filed May 15, 2021, published in English, which claims priority to European Application No. 20176127.7 filed May 22, 2020, the disclosures of which are incorporated herein by reference.

TECHNICAL FIELD

The present disclosure relates to an aerosol generation device in which an aerosol generating substrate is heated to form an aerosol. The disclosure is particularly applicable to a portable aerosol generation device, which may be self-contained and low temperature. Such devices may heat, rather than burn, tobacco or other suitable aerosol substrate materials by conduction, convection, and/or radiation, to generate an aerosol for inhalation.

BACKGROUND

The popularity and use of reduced-risk or modified-risk devices (also known as vaporisers) has grown rapidly in the past few years as an aid to assist habitual smokers wishing to quit smoking traditional tobacco products such as cigarettes, cigars, cigarillos, and rolling tobacco. Various devices and systems are available that heat or warm aerosolisable substances as opposed to burning tobacco in conventional tobacco products.

A commonly available reduced-risk or modified-risk device is the heated substrate aerosol generation device or heat-not-burn device. Devices of this type generate an aerosol or vapour by heating an aerosol substrate that typically comprises moist leaf tobacco or other suitable aerosolisable material to a temperature typically in the range 150° C. to 350° C. Heating an aerosol substrate, but not combusting or burning it, releases an aerosol that comprises the components sought by the user but not the toxic and carcinogenic by-products of combustion and burning. Furthermore, the aerosol produced by heating the tobacco or other aerosolisable material does not typically comprise the burnt or bitter taste resulting from combustion and burning that can be unpleasant for the user and so the substrate does not therefore require the sugars and other additives that are typically added to such materials to make the smoke and/or vapour more palatable for the user.

In such devices, a user typically loads the aerosol substrate into the aerosol generation device in the form of a consumable. Where the aerosol substrate is solid or compacted, the consumable may comprise the bare substrate. Alternatively, the aerosol substrate may be contained in a solid, loose material, or liquid form within a container.

In order to heat the aerosol substrate, the consumable is often placed in a heating chamber configured to supply heat in order to generate the aerosol. The heating chamber is accessed by a user to replace the consumable by, for example, opening a door in the device. However, this has the disadvantage that such access to the heating chamber typically affects insulation of the heating chamber and thus reduces heating efficiency.

One known solution is to provide a long insert which is detachable from a main body of the aerosol generation device. The user adds the consumable to be held in the insert and then slides the long insert into a correct position in the aerosol generation device. However, this is similar to an openable door in that the separable insert reduces insulation of the heating chamber and reduces heating efficiency.

As a result, it is desirable to provide an aerosol generation device configured to receive a consumable and heat the consumable in a heating chamber, without requiring a user to access the heating chamber to replace the consumable.

SUMMARY

According to a first aspect, the present disclosure provides an aerosol generation device comprising: a heating chamber for generating an aerosol by heating a consumable; a consumable port configured to receive the consumable; and a loader configured to move the consumable between a first position at the consumable port and a second position at the heating chamber, wherein the loader is configured to remain within the aerosol generation device at the first position and the second position.

By providing a loader as part of the aerosol generation device, the consumable can be replaced in the heating chamber without requiring a user to access the heating chamber, and without reducing insulation of the heating chamber.

Additionally, by providing a loader that remains inside the device, operation of the device can be simplified for the user, and the slider is protected within a housing of the device.

Optionally, the heating chamber comprises a heating element and the second position is adjacent to the heating element.

Optionally, the loader is a slider configured to move the consumable along a loading channel between the consumable port and the heating chamber.

A slider configured to move along a channel provides a robust and reliable mechanism.

Where the loader is a slider, optionally the loading channel comprises one or more protrusions or grooves for mechanically controlling the loader.

Such mechanical control provides a simple way of controlling behaviour of the loader as it moves along the channel.

Where the loader is a slider, the device may further comprise control circuitry, wherein the loader comprises a plurality of electrical contacts configured to contact with respective electrical contacts of the control circuitry, when the loader is at one or more positions.

Such electrical control provides an alternative way of controlling behaviour of the loader as it moves along the channel.

Where the loader is a slider, the device may comprises an air flow channel from an inlet, through the heating chamber and to an outlet, where the loading channel comprises a portion of the air flow channel.

By using the air flow channel, which is necessary for extracting generated aerosol, the loading channel can be provided with reduced impact on insulation of the heating chamber.

Where the loading channel comprises a portion of the air flow channel, the device may comprise a mouthpiece comprising the consumable port.

By including the consumable port in a mouthpiece, the device can be simply operated. Specifically, a position for a user to access aerosol at the mouthpiece is also a position for the user to access the consumable port.

Where the loading channel comprises a portion of the air flow channel, the device may further comprise an openable lid comprising the mouthpiece and covering the consumable port in a closed position.

By covering the consumable port with a lid comprising the mouthpiece, a position for a user to access aerosol at the mouthpiece is also a position for the user to access the consumable port, but the consumable does not need to actually come into contact with the mouthpiece.

Optionally, the device further comprises a handle mechanically linked to the loader.

A handle allows the user to indirectly position the consumable in the heating chamber, meaning the loader does not need to be powered.

Optionally, the loader comprises a gripping element configured to grip the consumable as the loader moves between the first and second positions.

By gripping the consumable, rather than pushing the consumable, any pressure applied to the consumable during movement between the first and second positions can be more precisely controlled, and the consumable is less likely to bend or become stuck while being moved.

An aerosol generation device according to any preceding claim, wherein the loader comprises a compression element configured to compress the consumable against a wall of the heating chamber.

Compressing the consumable while it is being heated has the effect of improving aerosol generation yield.

Optionally, the loader comprises an ejector element configured to eject the consumable at least partly out of the consumable port.

The ejector element makes it easier to unload the consumable after use in the aerosol generation device. For example, aerosol substrates can release an oily or sticky substance upon heating and aerosol generation, and can be more difficult to remove from an aerosol generation device than they were to insert.

An aerosol generation device according to any preceding claim, wherein the loader comprises a loader heating element.

By providing a heating element in the loader, a heating rate can be increased, and uniformity of heating can be improved.

Optionally, the loader heating element is detachable and the consumable port is configured to enable access to the loader heating element.

By providing a detachable heating element in the loader, the heating element can be more easily replaced when the loader is in the first position.

Optionally, the aerosol generation device further comprises a locking element operable to lock the loader in the second position or operable to prevent the loader from returning to the first position. Preferably, the locking element is automatically controlled based on a temperature sensor in order to prevent the consumable from returning to the first position after aerosol generation before it has cooled to a safe handling temperature.

DETAILED DESCRIPTION

Figure 1A:
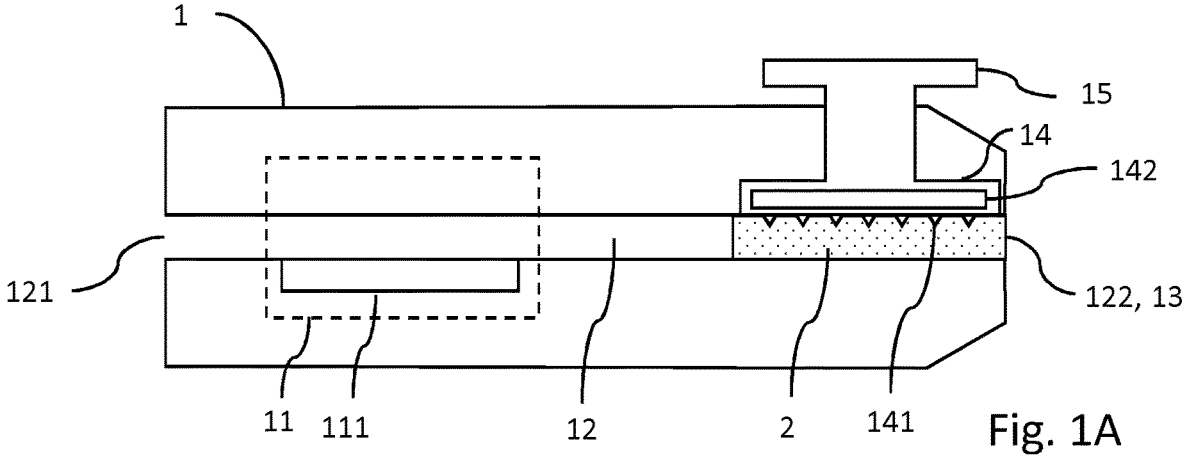
FIGS. 1A to 1C are schematic cross-sections of an aerosol generation device having a loader.
Figure 1B:
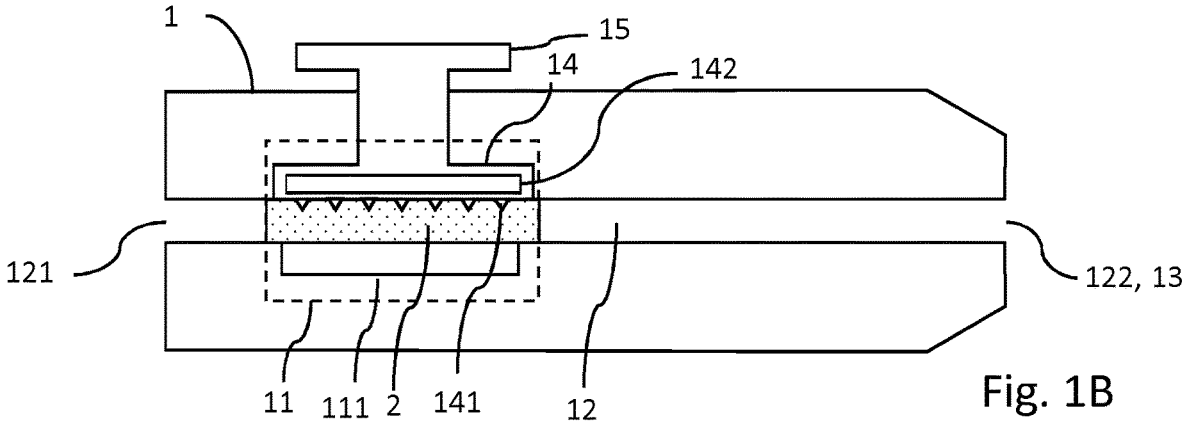
Figure 1C:
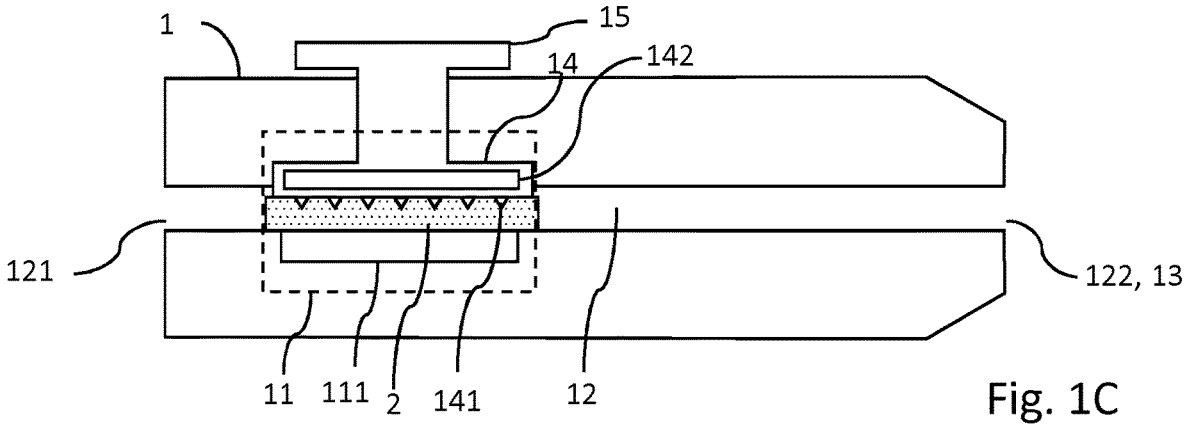

FIGS. 1A to 1C are schematic cross-sections of an aerosol generation device 1.

The aerosol generation device 1 comprises a heating chamber 11 configured to generate an aerosol by heating a consumable 2.

In this embodiment, the heating chamber 11 comprises a heating element 111. The heating element 111 may for example be an electric heating element configured to receive power from a power supply (either located in the aerosol generation device 1 or connected externally) and configured to perform resistive heating. The aerosol generation device 1 may also comprise control circuitry (not shown) for controlling activation of the heating element. In alternatives, other types of heating element, such as fuel-burning heating elements, may be used.

The heating chamber 11 is connected to an air flow channel 12 from an inlet 121, through the heating chamber 11 and to an outlet 122, to transport the aerosol out of the heating chamber 11. In this case, the outlet 122 is formed as a mouthpiece for a user to inhale the aerosol generated in the heating chamber 11. In other embodiments, the aerosol generation device 1 may comprise a pump for pumping the aerosol out of the heating chamber in the air flow channel.

The consumable 2 may for example be a self-supporting portion of an aerosol substrate. In a typical example, the consumable may be approximately cuboid. The substrate may comprise nicotine or tobacco and an aerosol former. Tobacco may take the form of various materials such as shredded tobacco, granulated tobacco, tobacco leaf and/or reconstituted tobacco. Suitable aerosol formers include: a polyol such as sorbitol, glycerol, and glycols like propylene glycol or triethylene glycol; a non-polyol such as monohydric alcohols, acids such as lactic acid, glycerol derivatives, esters such as triacetin, triethylene glycol diacetate, triethyl citrate, glycerin or vegetable glycerin. In some embodiments, the aerosol generating agent may be glycerol, propylene glycol, or a mixture of glycerol and propylene glycol. The substrate may also comprise at least one of a gelling agent, a binding agent, a stabilizing agent, and a humectant.

The substrate may be porous such that air can flow through the substrate and collect aerosol as it does so. The substrate may for example be a foam, or packed strands or fibres. Alternatively, in cases where the substrate is not porous, the substrate may form a vapour on its surface, and the vapour may form an aerosol in an air flow travelling past its surface. The substrate may be formed through an extrusion and/or rolling process into a stable shape.

In addition to being porous, the aerosol substrate may be shaped to provide one or more air flow channels. These can be aligned with the air flow channel 12 of the aerosol generating device 1 in order to increase air flow through the heating chamber 11.

The consumable may further comprise an air permeable wrapper covering at least part of a surface of the aerosol generating substrate. The wrapper may, for example, comprise paper and/or non-woven fabric.

In order to position the consumable 2 in the heating chamber 11, the aerosol generation device 1 further comprises a consumable port 13 configured to receive the consumable 2, and a loader 14 configured to move the consumable 2 between a first position at the consumable port 13 (as shown in FIG. 1A) and a second position at the heating chamber 11 (as shown in FIGS. 1B and 1C). In this example, the second position is adjacent to the heating element 111, so that the consumable 2 is arranged for heating.

The consumable port 13 is an opening on an exterior of the aerosol generation device 1 that is sized to receive the consumable in the first position, so that the loader can then move the consumable to the second position. For example, the consumable port 13 may provide access for a user to position the consumable in the first position.

Additionally, when the consumable 2 has been used to generate an aerosol, the consumable port 13 may be used to remove the consumable 2 from the aerosol generation device 1. An output consumable port for removing the consumable may be different from the consumable port 13 for receiving the consumable 2; in this case, the loader 14 may be configured to move the consumable 2 from a first position at the consumable port 13 to a second position at the heating chamber 11 and then to a third position at the output consumable port. The consumable port 13 (or consumable ports) may be closeable with a lid (not shown).

The loader 14 is a part configured to move within the aerosol generation device 1, and to move the consumable 2 at the same time. For example, in the embodiment of FIGS. 1A to 1C, the loader 14 is a slider configured to move the consumable along a loading channel between the consumable port and the heating chamber.

As shown in FIGS. 1A to 1C, in this embodiment, the loading channel is a part of the air flow channel 12 and the consumable port 13 is also the outlet 122 of the air flow channel, although in other embodiments this may not be the case. For example, the consumable port 13 may be the inlet 121 of the air flow channel 12. As a further alternative, the loading channel may be arranged perpendicular to the air flow channel 12, and the consumable port 13 may not be part of the air flow channel 12.

The loader 14 may have a variety of features to assist with moving the consumable 2 between the first and second positions, or to assist with heating.

In the example of FIGS. 1A to 1C, the loader 14 comprises a gripping element 141 configured to grip the consumable 2 as the loader 14 moves between the first and second positions. The gripping element may take the form of one or more protrusions (e.g. spikes) or ribs which grip the consumable 2 either by friction or by penetrating the consumable 2. Alternatively, the loader 14 may simply have a surface which provides sufficient static friction to hold the consumable 2 in place as the loader 14 moves, or may have a pushing element which pushes the consumable 2 from behind relative to the direction of motion.

Additionally, in the example of FIGS. 1A to 1C, the loader 14 comprises a loader heating element 142 configured to provide additional heating for the consumable 2 when the loader 14 is in the second position. The loader heating element 142 may be similar to the heating element 111. For example, if the loader heating element 142 is an electric heating element, the loader heating element 142 may receive power via sliding electrical contact pairs arranged on the slider 14 and the loading channel. The sliding electrical contact pairs may be configured such that the loader heating element 142 only receives power when the loader 14 is in the second position.

In addition to assisting with heating of the consumable 2, the loader heating element 142 can be configured to assist with maintenance of the aerosol generation device 1. Namely, the loader heating element 142 may be configured to be detachable from the loader 14, and the consumable port 13 may be configured to enable access to the loader heating element 142. With this configuration, the loader heating element 142 can be relatively easily removed for cleaning or replacement.

The aerosol generation device 1 can be operated with only one heating element, so either of heating element 111 or loader heating element 142 may be omitted n some embodiments.

The aerosol generation device 1 may have further features to assist with maintenance of the aerosol generation device 1. For example, the loading port 13 may be configured to open to a maintenance position at which the loader 14 can be removed from its normal position within the housing of the aerosol generation device 1. When the loader 14 is removed, the loader 14 and/or the loading channel may be cleaned. For example, the loader 14 and/or the loading channel may be cleaned with a foam or sponge part to remove condensation from the aerosol, and to remove residue from the substrate. Additionally, the loader 14 may be a replaceable part, for example being replaced after approximately 50 consumables 2 have been loaded and used in the device 1.

Furthermore, the loading port 13 may be configured to receive a cleaning element, such as a foam or sponge with similar dimensions to the consumable 2. The cleaning element may be "loaded" along the loading channel in the same way as the consumable 2, in order to wipe out the loading channel without opening the loading port 13 to a maintenance position.

Additionally, in the example of FIGS. 1A to 1C, the loader 14 is mechanically linked to a handle 15. The handle 15 may be manually operated to move the loader 14 between the first and second positions. In alternative embodiments, the loader 14 may be moved by other means such as an electrical actuator, eliminating the need for a handle 15. However, manual operation by the handle 15 has the advantage of reducing the complexity of the device 1 and reducing the number of possible failure points. More specifically, an actuator could be a limiting factor on the lifetime of the aerosol generation device 1 if the actuator is vulnerable to damage in the hot conditions of the heating chamber 11 in use, or vulnerable to blockage by residue of aerosol generation.

The handle 15 may also be configured to enable manual compression of the consumable 2 via the loader 14, as illustrated in FIG. 1C. Such compression increases friction for moving the consumable 2 between the first and second positions. Additionally, the inventors have found that compressing the consumable 2 during heating can increase aerosol generation. Therefore, it is particularly advantageous to configure the handle 15 and loader 14 to enable manual compression of the consumable 2 against a wall of the heating chamber 11, when the loader 14 is in the second position, and particularly where the consumable 2 is compressed near to the heating element 111 (where present).

Figure 2A:
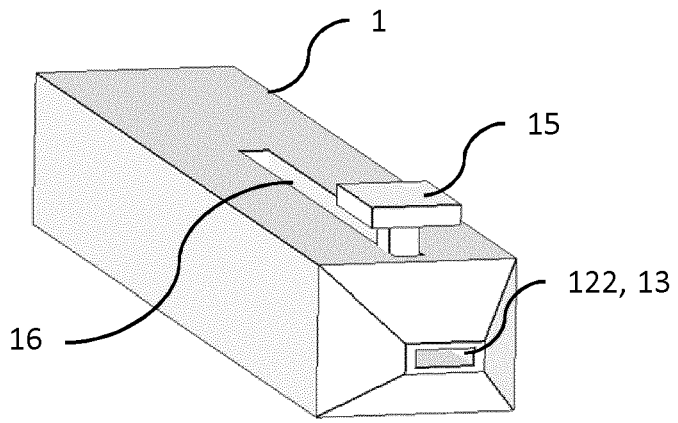
FIGS. 2A and 2B are schematic perspective illustrations of an aerosol generation device.
Figure 2B:
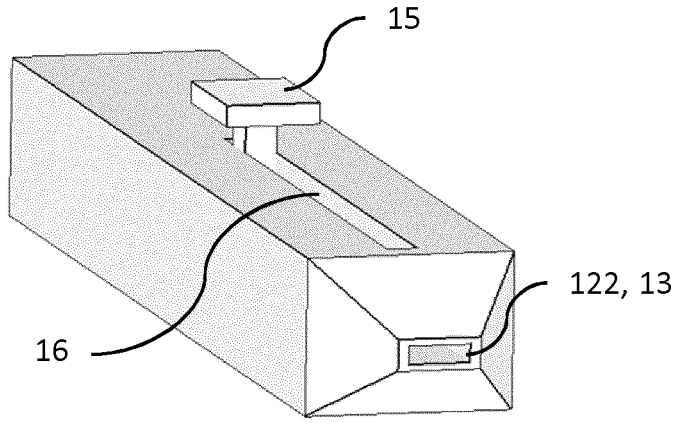

FIGS. 2A and 2B are schematic perspective illustrations of an aerosol generation device, providing additional context for the cross-section illustrations of FIGS. 1A to 1C.

As shown in FIG. 2A, the mechanical linkage between the handle 15 and the loader 14 (not visible in FIG. 2A) extends through a slot 16. By sliding the handle 15 along the slot 16, the loader 14 is moved from the first position (FIGS. 1A and 2A) to the second position (FIGS. 1B and 2B).

In order to prevent the slot 16 from affecting air flow in the air flow channel 12, the slot 16 may be made as narrow as possible, and may be provided with a self-sealing element, such as a strip of an elastomer material. Alternatively, the mechanical linkage may be an indirect link, for example via a pivot or cable, such that there is no air connection between the air flow channel 12 and the exterior mechanism of the handle 15.

Figure 3A:
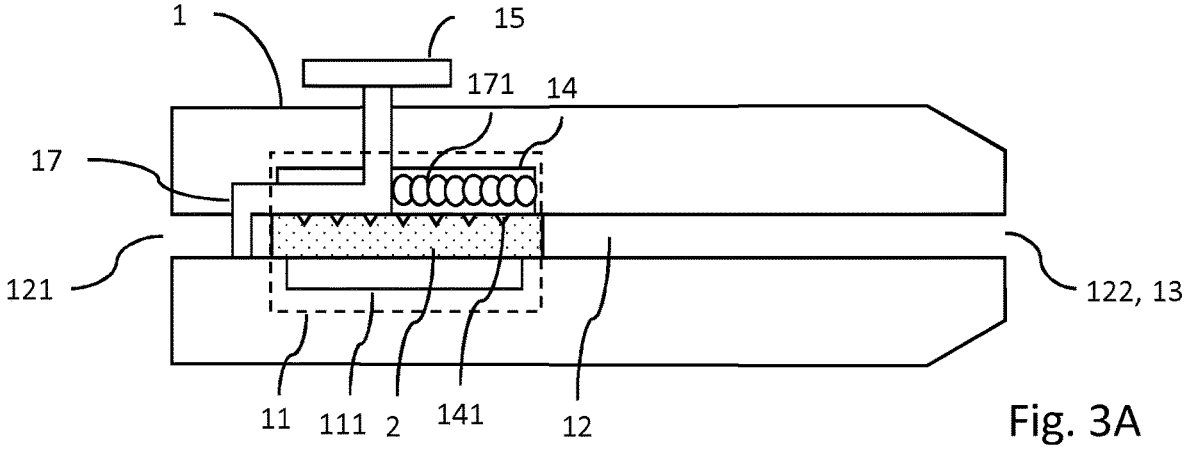
FIGS. 3A to 3C are schematic cross-sections of an aerosol generation device having an ejector element.
Figure 3B:
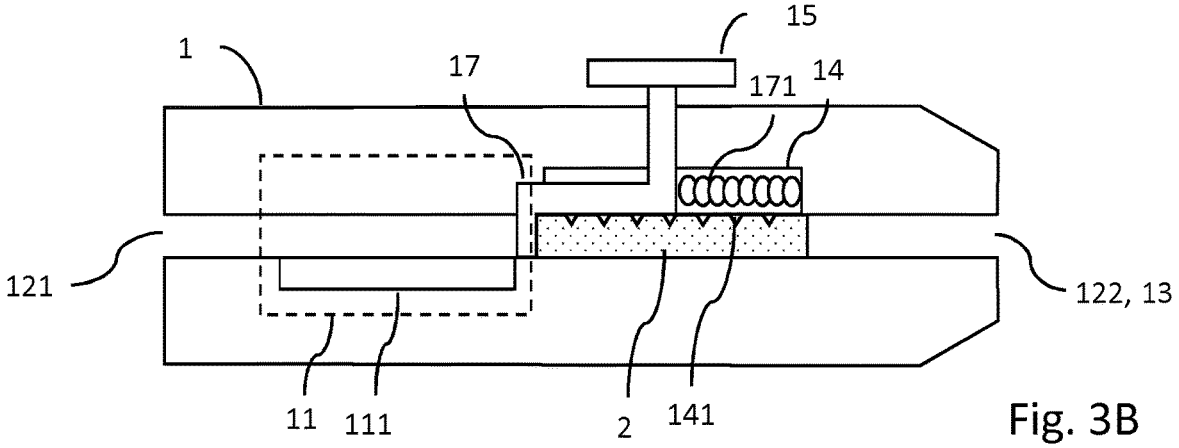
Figure 3C:
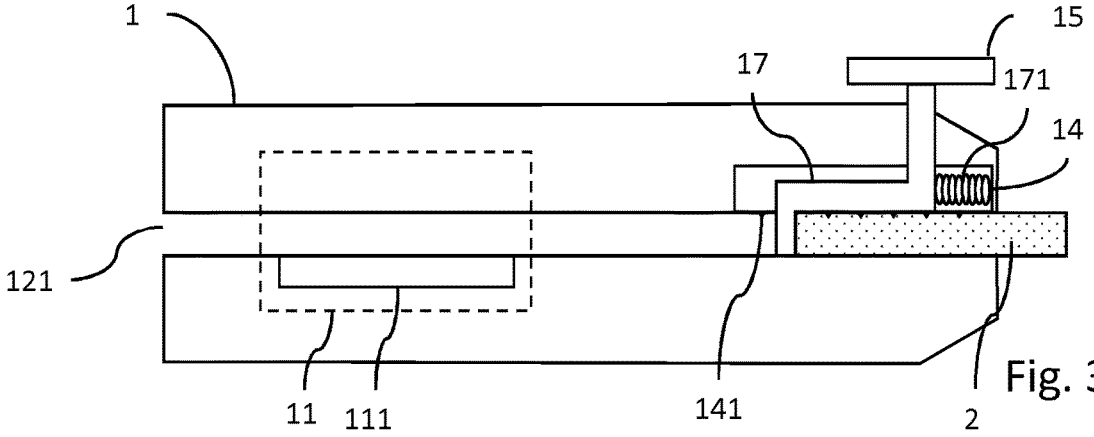

FIGS. 3A to 3C are schematic cross-sections of an aerosol generation device 1 having an ejector element 17. This is a variant of the aerosol generation device 1 shown in FIGS. 1A to 1C, where the same figure references refer to the same features, and only the differences are described here.

The ejector element 17 is an element that is attached to the loader 14 but configured to move relative to the loader 14 in order to eject the consumable 2 at least partly out of the consumable port 13.

The loader 14 is connected to the ejector element 17 via a linkage 171. The linkage 171 may be a channel with defined ends, so that the ejector element 17 has a defined range of motion relative to the loader 14, but is not constrained within the range of motion. Alternatively, as shown in FIGS. 1A to 1C, the linkage 171 may be a resilient element (e.g. a spring) configured to bias the ejector element 17 to a default position where there is a space between the consumable 2 and the ejector element 17 (as shown in FIG. 3A).

The ejector element 17 may be configured such that, when the loader 14 moves from the first position to the second position, the ejector element 17 does not interact with the consumable. On the other hand, when the loader 14 moves from the second position to the first position, the ejector element 17 moves relative to the loader to eject the consumable 2 at least partly out of the consumable port 13. The resilient element (where present) can then reset the ejector element 17 to its default position relative to the loader 14.

In the embodiment shown in FIGS. 3A to 3C, the handle 15 is connected to the ejector element 17, and the resilient element 171 transfers force to the loader 14, so that the handle 15 can be used to move the loader 14 as shown in FIGS. 1A to 1C. Alternatively, the ejector element 17 may be electrically actuated to move relative to the loader 14, and the handle 15 may either be mechanically linked directly to the loader 14 or may be omitted.

FIGS. 3A to 3C illustrate a further optional feature (which can be included independently from the ejector element 17). Namely, the gripping element 141 may be configured to retract when the loader 14 is in the first position. This may be controlled with an electrical actuator (for example, an electrical contact pair similar to that described for the loader heating element 142) or a mechanical system. This configuration makes it easier to add or remove the consumable 2 through the consumable port 13, while still providing a gripping effect for moving the consumable 2 between the first and second positions.

Figure 4A:
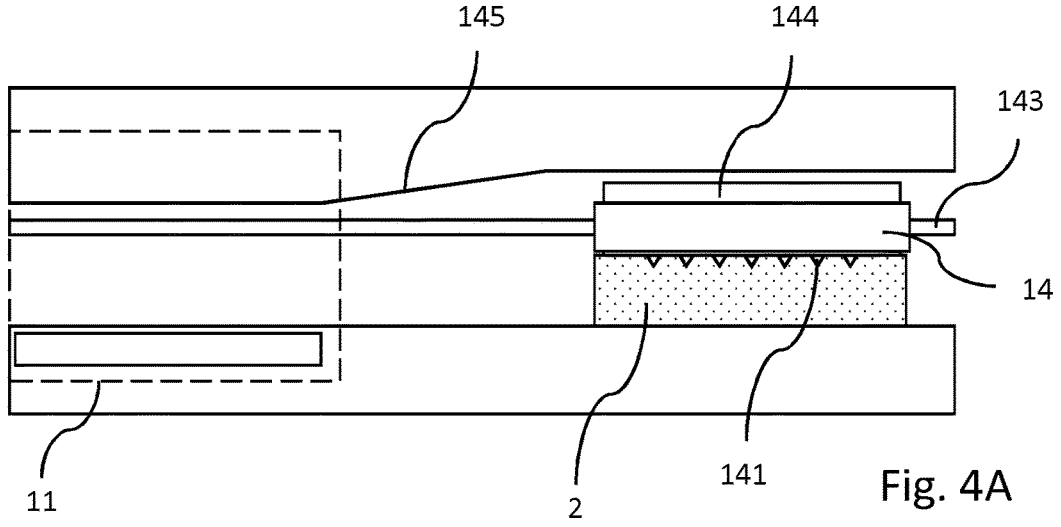
FIGS. 4A and 4B are schematic cross-sections of an aerosol generation device having a compression element.
Figure 4B:
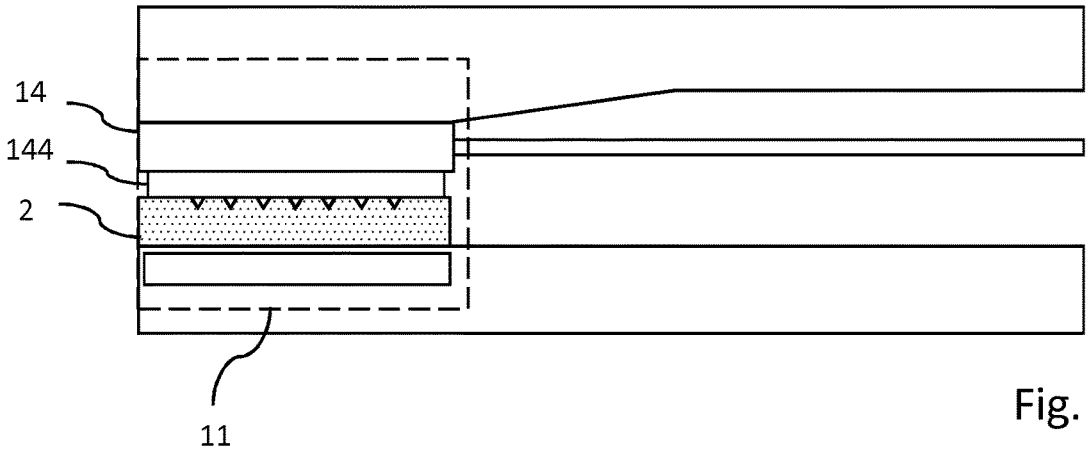

FIGS. 4A and 4B are schematic cross-sections of an aerosol generation device having a compression element 144. This is a variant of the aerosol generation device 1 shown in FIGS. 1A to 1C or FIGS. 3A to 3C, where the same figure references refer to the same features, and only the differences are described here.

In FIG. 1C, the handle 15 was used to manually compress the consumable 2 via the loader 14. As an alternative to this, the loader 14 may comprise a compression element 144 configured to automatically compress the consumable 2 when the loader 14 is in the second position.

As shown in FIG. 4A, the loader 14 may be constrained to move along a rail 143 defined in the loading channel. A surface 145 of the loading channel may be configured at a variable distance from the rail 143 to provide one or more protrusions or grooves for mechanically controlling the loader.

The rail 143 and variable surface 145 may be used to operate the compression element 144 automatically as shown in FIGS. 4A and 4B. Namely, as a distance between the surface 145 and the rail 143 decreases, the compression element 144 is pushed towards the consumable 2 to compress the consumable. When the loader 14 moves in the opposite direction back along the rail, the distance between the surface 145 and the rail 143 increases, and the compression element 144 is released and returns to a non-compressing position either due to resilience of the consumable 2, or due to the presence of a further resilient element (not shown).

The surface 145 and rail 143 can similarly be used to control, for example, the ejector element 17 or the gripping element 141 depending upon a position of the loader 14 along the loading channel.

Alternatively, the compression element may be electrically actuated, for example being powered by a common sliding electrical connection also used for the loader heating element 142 (where present).

Figure 5A:
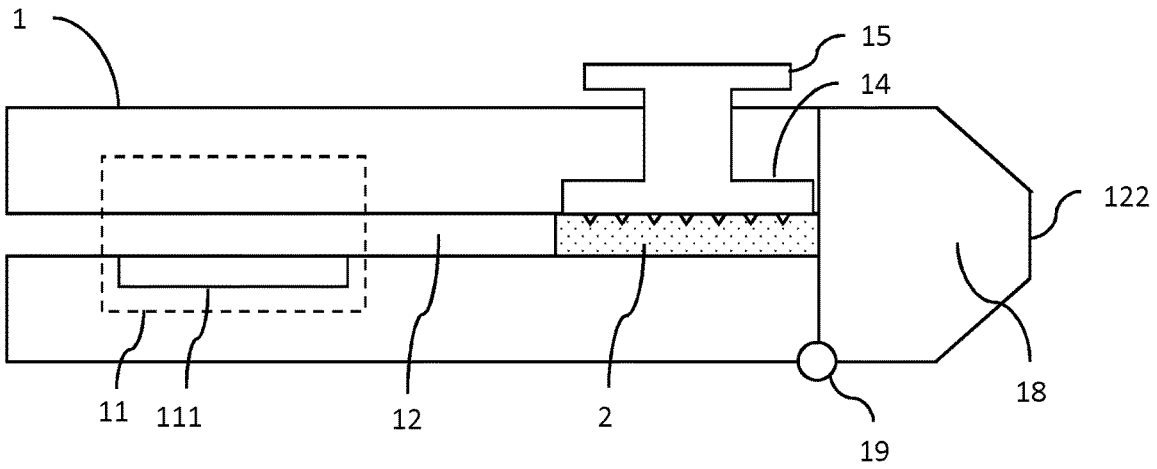
FIGS. 5A and 5B are schematic cross-sections of an aerosol generation device having a moveable mouthpiece.
Figure 5B:
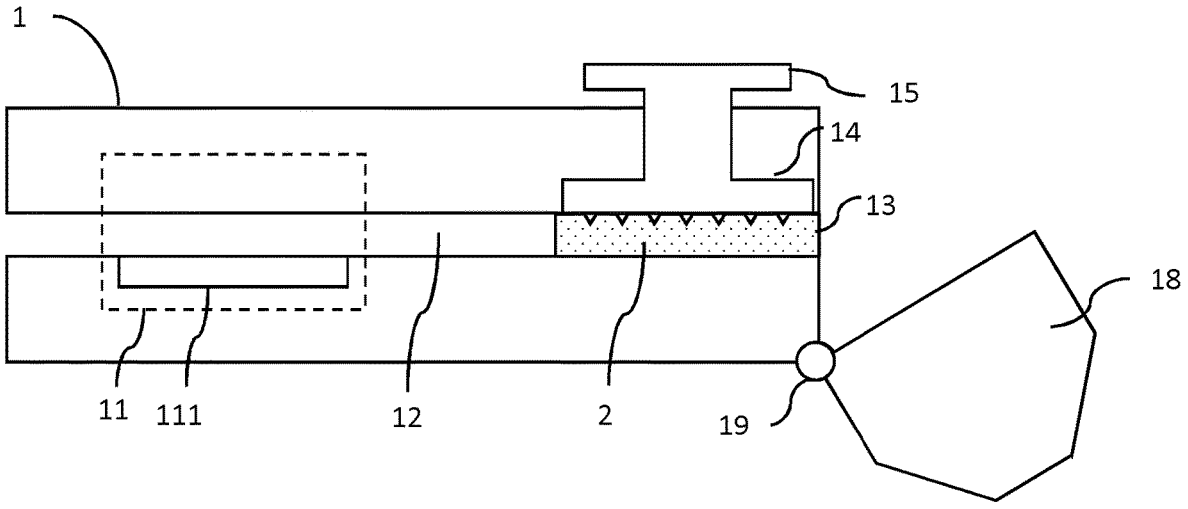

FIGS. 5A and 5B are schematic cross-sections of an aerosol generation device 1 having a moveable mouthpiece 18.

More specifically, the embodiment is a variant of any of the above described embodiments, with a further optional feature of an openable lid 18 comprising the mouthpiece, the lid 18 being configured to cover the consumable port 13 in a closed position.

The lid 18 may be entirely detachable, or may be attached to a main body of the aerosol generation device 1, for example using a hinge 19.

FIG. 5A illustrates the closed position, where the air flow channel 12 connects through to the mouthpiece to provide outlet 122 at the end of the lid 18.

FIG. 5B illustrates an open position, where the consumable port 13 is accessible.

Comparing the optional features of FIGS. 5A and 5B to the example of FIGS. 1A to 1C, the openable lid 18 has the advantage that the consumable 2 does not need to contact the outlet 122, and therefore there is less likely to be debris from the consumable 2 found at the outlet 122. The user may place their mouth near the outlet 122 to inhale the aerosol, and therefore the openable lid 18 enhances the aerosol inhaling experience of a user by reducing the likelihood of inhalation of solid material which may affect the taste of the aerosol.

Figure 6A:
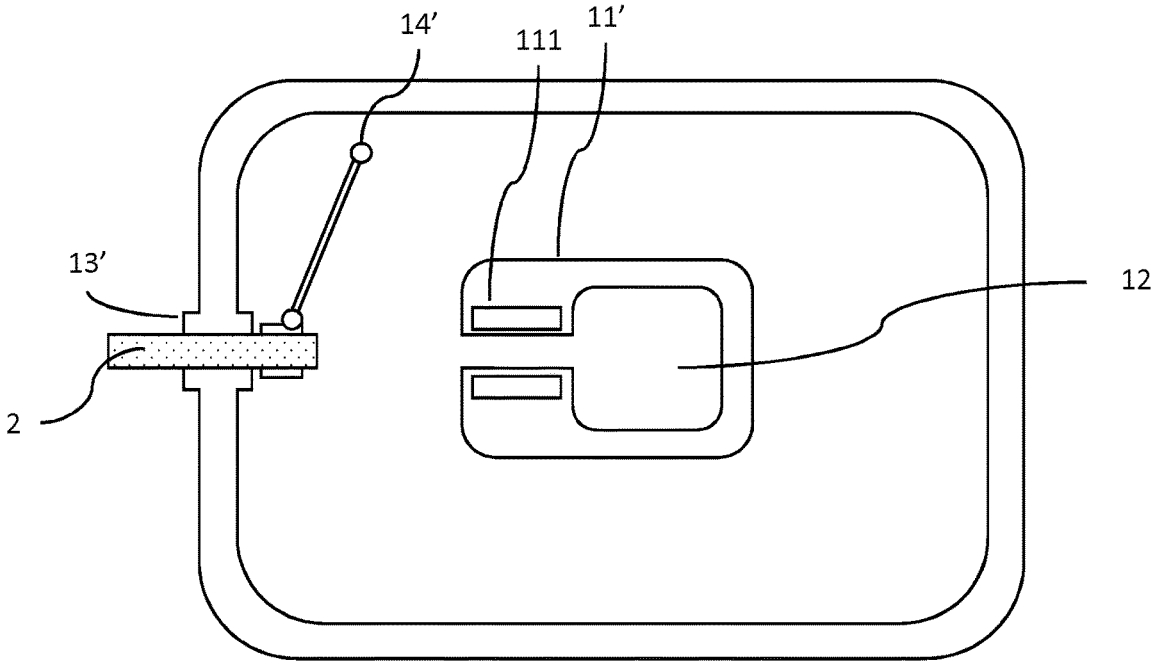
FIGS. 6A and 6B are schematic cross-sections of an alternative aerosol generation device having a loader.
Figure 6B:
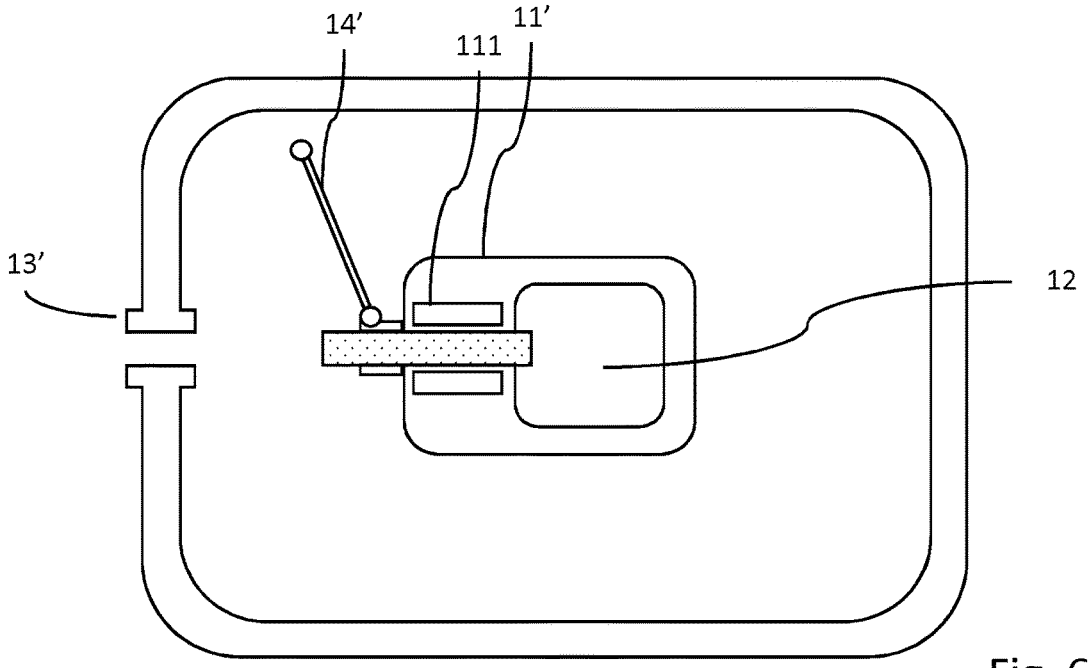

FIGS. 6A and 6B are schematic cross-sections of an alternative aerosol generation device having a different type of loader 14' which is not a slider.

More specifically, in the alternative embodiment of FIGS. 6A and 6B, the loader 14' and the consumable port 13' are separate from the air flow channel 12. For example, the loader 14' and the consumable port 13' may be configured to move the consumable 2 between first and second positions that are on a line perpendicular to the air flow channel 12.

In the example shown in FIGS. 6A and 6B, the loader 14' takes the form of a pivoting and swinging mechanism anchored in a housing of the aerosol generation device.

The loader 14' moves the consumable from a first position at the consumable port 13', through a void inside the housing, to a second position adjacent to a heating element 111 of a heating chamber 11.

As air is drawn along the air flow channel 12, an air pressure adjacent to the consumable 2 drops, and aerosol is drawn from the consumable 2 into the air flow channel 12. Alternatively, a side-loading mechanism similar to FIGS. 6A and 6B can be used to position the consumable 2 at a second position in the air flow channel 12, so that more aerosol is drawn out by the user's inhalation.

A further optional feature of aerosol generation devices according to the above description is a locking element operable to lock the loader in the second position or operable to prevent the loader from returning to the first position. The locking element may for example be a peg arranged in the loading channel which extends to block the loader from moving past the peg along the loading channel, or which extends into a slot in the loader to hold the loader in place.

Preferably, the locking element is automatically controlled based on a temperature sensor in order to prevent the consumable from returning to the first position after aerosol generation before the consumable has cooled to a safe handling temperature. For example, the locking element may simply have a temperature dependent shape (e.g. a bimetallic strip) and may extend to block or hold the loader when above a threshold temperature. Alternatively, the loader 14 or the loading channel may comprise a temperature sensor connected to control circuitry, and the control circuitry may be configured to actively actuate the locking element when a sensed temperature is above a threshold temperature.

The invention claimed is:

1. An aerosol generation device comprising:

a heating chamber for generating an aerosol by heating a consumable;

a consumable port configured to receive the consumable;

a loading channel disposed between the consumable port and the heating chamber; and a loader having a gripping element configured to grip the consumable, the loader being configured to move the consumable between a first position at the consumable port and a second position at the heating chamber, wherein the loader is configured to remain within the aerosol generation device at the first position and the second position, wherein the heating chamber comprises a heating element disposed outside of the loading channel and within the aerosol generation device and the second position is adjacent to the heating element, wherein the consumable is completely contained within the device while being actuated between the first position and the second position, and wherein the loader is configured to move along an airflow direction of the aerosol generation device.

2. The aerosol generation device according to claim 1, wherein the loader is a slider configured to move the consumable along the loading channel between the consumable port and the heating chamber.

3. The aerosol generation device according to claim 2, wherein the loading channel comprises one or more protrusions or grooves for mechanically controlling the loader.

4. The aerosol generation device according to claim 2, further comprising control circuitry, wherein the loader comprises a plurality of electrical contacts configured to contact with respective electrical contacts of the control circuitry, when the loader is at one or more positions, and wherein the control circuitry is completely within the aerosol generation device.

5. The aerosol generation device according to claim 2, further comprising an air flow channel from an inlet, through the heating chamber and to an outlet, and the loading channel comprises a portion of the air flow channel.

6. The aerosol generation device according to claim 5, further comprising a mouthpiece comprising the consumable port.

7. The aerosol generation device according to claim 6, further comprising an openable lid comprising the mouthpiece and covering the consumable port in a closed position.

8. The aerosol generation device according to claim 1, further comprising a handle mechanically linked to the loader.

9. The aerosol generation device according to claim 1, wherein the loader comprises a compression element configured to compress the consumable against a wall of the heating chamber in a direction towards the heating element.

10. The aerosol generation device according to claim 1, wherein the loader comprises an ejector element configured to eject the consumable at least partly out of the consumable port.

11. The aerosol generation device according to claim 1, wherein the loader comprises a loader heating element.

12. The aerosol generation device according to claim 11, wherein the loader heating element is detachable and the consumable port is configured to enable access to the loader heating element.

13. The aerosol generation device according to claim 1, further comprising a locking element operable to lock the loader in the second position or operable to prevent the loader from returning to the first position.

14. The aerosol generation device according to claim 9, the loading channel further comprising a rail defined within the loading channel, wherein the rail extends between the consumable port and the heating chamber.

15. The aerosol generation device according to claim 14, the loading channel further comprising a variable surface disposed within the loading channel defining a variable distance between the variable surface and the rail that extends along the loading channel, wherein the variable distance at the consumable port is larger than the variable distance at the heating chamber, wherein the variable surface is configured to provide for the automatic operation of the compression element as the loader travels along the loading channel from the consumable port towards the heating chamber.

16. An aerosol generation device comprising:

a heating chamber for generating an aerosol by heating a consumable, the heating chamber comprising a heating element;

control circuitry;

a mouthpiece comprising a consumable port configured to receive the consumable;

a loading channel disposed between a consumable port and the heating chamber;

a loader configured to move the consumable between a first position at the consumable port and a second position at the heating chamber;

an air flow channel from an inlet, through the heating chamber and to an outlet, and the loading channel comprises a portion of the air flow channel; and an openable lid comprising the mouthpiece and covering the consumable port in a closed position, wherein the loader is configured to remain within the aerosol generation device at the first position and the second position, wherein the loader comprises a plurality of electrical contacts configured to contact with respective electrical contacts of the control circuitry, when the loader is at one or more positions, and wherein the heating element is disposed outside of the loading channel and within the aerosol generation device.

* * * * *